US007992581B2

(12) United States Patent
Hoogendoorn

(10) Patent No.: US 7,992,581 B2
(45) Date of Patent: Aug. 9, 2011

(54) CANOPY DEVICE

(75) Inventor: Gerrit Hoogendoorn, Delft (NL)

(73) Assignee: Senz Technologies B.V., Delft (NL)

( * ) Notice: Subject to any disclaimer, the term of this patent is extended or adjusted under 35 U.S.C. 154(b) by 150 days.

(21) Appl. No.: 11/921,780

(22) PCT Filed: Jun. 7, 2006

(86) PCT No.: PCT/NL2006/000281

§ 371 (c)(1),
(2), (4) Date: Mar. 19, 2008

(87) PCT Pub. No.: WO2006/132525

PCT Pub. Date: Dec. 14, 2006

(65) Prior Publication Data

US 2009/0126769 A1 May 21, 2009

(30) Foreign Application Priority Data

Jun. 9, 2005 (NL) ..... 1029225

(51) Int. Cl.
*A45B 25/00* (2006.01)

(52) U.S. Cl. ..... 135/31; 135/32

(58) Field of Classification Search ..... 135/31, 135/29, 19.5, 32

See application file for complete search history.

(56) References Cited

U.S. PATENT DOCUMENTS

| | | | | |
|---|---|---|---|---|
| 229,685 | A * | 7/1880 | Ege | 135/28 |
| 895,390 | A * | 8/1908 | McGuire | 135/31 |
| 1,001,076 | A * | 8/1911 | Redford | 135/29 |
| 1,063,989 | A | 6/1913 | McCabe | |
| 1,749,363 | A | 3/1930 | Venner, Jr. | |
| 2,111,578 | A | 3/1938 | Weaver | |
| 2,144,141 | A | 1/1939 | Brandon | |
| 2,157,670 | A * | 5/1939 | Ono | 135/25.3 |
| 3,069,021 | A * | 12/1962 | Gray | 211/197 |
| 3,252,468 | A * | 5/1966 | Militano | 135/28 |
| 3,456,661 | A | 7/1969 | Farley | |

(Continued)

FOREIGN PATENT DOCUMENTS

AU 572753 5/1988

(Continued)

OTHER PUBLICATIONS

PCT International Search Report, Jan. 30, 2007.

(Continued)

*Primary Examiner* — Noah Chandler Hawk
(74) *Attorney, Agent, or Firm* — The Webb Law Firm

(57) ABSTRACT

The present invention relates to a canopy device, in particular an umbrella or parasol, comprising:

a rod;

a canopy of flexible material connected to the rod close to an end thereof;

operating means displaceable along the rod for closing or opening the canopy; and means for tensioning the canopy, which canopy tensioning means comprise a set of first tensioning members and a set of second tensioning members, wherein the first tensioning members are each pivotally connected with one first outer end to the rod and extend therefrom along the canopy to a position close to the periphery thereof, and wherein the second tensioning members are each pivotally connected with a first outer end to the operating means and are connected with a second outer end to a corresponding first tensioning member, wherein the connection between the first and second tensioning members is arranged closer to the periphery of the canopy than to the rod, and is preferably situated substantially close to the periphery of the canopy.

19 Claims, 10 Drawing Sheets

U.S. PATENT DOCUMENTS

| | | | | |
|---|---|---|---|---|
| 3,765,433 | A * | 10/1973 | Futamura et al. | 135/15.1 |
| 5,372,155 | A | 12/1994 | You | |
| 5,555,903 | A | 9/1996 | Rizzotti | |
| 5,690,131 | A | 11/1997 | Voigt | |
| 5,826,604 | A | 10/1998 | Hartmann | |
| 6,298,867 | B1 | 10/2001 | Chang | |
| 6,941,959 | B2 * | 9/2005 | Kung-Tai | 135/33.7 |
| 2011/0048480 | A1 * | 3/2011 | Riera et al. | 135/29 |

FOREIGN PATENT DOCUMENTS

| | | | |
|---|---|---|---|
| AU | 572753 | B2 | 5/1988 |
| BE | 381251 | | 8/1931 |
| BE | 1015996 | A3 | 1/2006 |
| DE | 58359 | | 11/1890 |
| DE | 3708921 | | 9/1988 |
| DE | 3708921 | A1 | 9/1988 |
| DE | 19635030 | | 3/1998 |
| DE | 19635030 | A1 | 3/1998 |
| EP | 0829598 | A1 | 9/1997 |
| EP | 0829598 | | 3/1998 |
| FR | 1380763 | | 3/1965 |
| FR | 2598895 | | 11/1987 |
| FR | 2598895 | A | 11/1987 |
| GB | 191029101 | | 0/1911 |
| GB | 191029101 | A | 0/1911 |
| GB | 2197672 | | 5/1988 |
| GB | 2197672 | A | 5/1988 |
| NL | 1001475 | | 10/1995 |
| NL | 1001475 | | 4/1997 |
| NL | A/07/08418 | | 6/2008 |
| WO | 0160193 | A1 | 8/2001 |
| WO | WO 2005/102098 | | 11/2005 |
| WO | WO 2005-102098 | A1 | 11/2005 |
| WO | WO 2006/049706 | | 5/2006 |
| WO | WO 2006-049706 | A2 | 5/2006 |

OTHER PUBLICATIONS

International-Type Search Report, Dec. 3, 2004, ISR.

* cited by examiner

CANOPY DEVICE

The present invention relates to a shielding or canopy device, in particular an umbrella or parasol, comprising a rod, a canopy of flexible material connected to the rod close to an end thereof, with operating means displaceable along the rod for closing or opening the canopy and means for tensioning the canopy, which canopy tensioning means comprise a set of first tensioning members and a set of second tensioning members, wherein the first tensioning members are each pivotally connected with one first outer end to the rod and extend therefrom along the canopy to a position close to the periphery thereof, and wherein the second tensioning members are each pivotally connected with a first outer end to the operating means and are connected with a second outer end to a corresponding first tensioning member. Such a canopy device is generally known and is normally referred to as an umbrella or parasol.

The umbrella is very old and has evolved from sunshade for the well-to-do to an umbrella which is now a completely normal sight on a rainy day.

Present umbrellas are vulnerable and not wind-resistant, particularly at a wind speed greater than four on the Beaufort scale. Even the so-called wind-resistant umbrellas are very uncomfortable in a strong wind. Rain occurs regularly in combination with wind, whereby there is a need for an umbrella which is still comfortable in the case of strong wind, i.e. also at a wind speed greater than four on the Beaufort scale, and which is moreover so robust that it does not collapse. Much of the damage occurring in existing umbrellas takes place on or around the pivot points arranged on the ribs. In addition, the tipped protrusions of the umbrella often represent a hazard for passers-by, all the more so as these protrusions are often situated at eye level.

It is the object of the present invention to propose a canopy device of the type stated in the introduction wherein the stated problems are avoided and additional advantages are also provided.

According to a first aspect of the invention, this object is achieved in a canopy device of the above described type in that the connection between the first and second tensioning members is arranged closer to the periphery of the canopy than to the rod, and is preferably situated substantially close to the periphery of the canopy.

The canopy device according to the present invention forms a robust umbrella in that an alternative is provided for the vulnerable pivot points which in present umbrellas are often mounted on the ribs. Absorption of the forces takes place via generation of contact surfaces of the ribs.

As a result of their generally circular and therefore poor aerodynamic form, conventional umbrellas are often very unstable when exposed to windy weather conditions. By improving the stability a canopy device is proposed according to a second aspect of the invention wherein the canopy has an asymmetrical form, the rod is connected eccentrically to the canopy, and the tensioning members have differing lengths. Because the canopy has an asymmetrical form, the canopy device according to the present invention has improved aerodynamics which ensure that the canopy device will seek to take up a stable position when exposed to gusts of wind. As a result the resistance will decrease discernibly and it will be possible to handle the umbrella according to the present invention more comfortably in windy weather conditions. Furthermore, due to this self-adjusting equilibrium the canopy device is less likely to be overloaded, which will enhance durability.

A vulnerable point in known umbrellas is the pivot connection between the ribs and the closing and opening mechanism. According to a third aspect, the invention therefore provides a canopy device wherein the pivotable connection between the operating means and each of the second tensioning members comprises a substantially flexible pivoting element, which is connected on one side to the first outer end of the second tensioning member and on the other side to the displaceable operating means.

Preferred embodiments of the canopy device according to the invention are described in the sub-claims.

Finally, the invention further relates to canopy tensioning means and a pivot connection for use in a canopy device as described here.

An exemplary embodiment is further elucidated in the following descriptions with reference to the drawing, in which.

Figure 1:
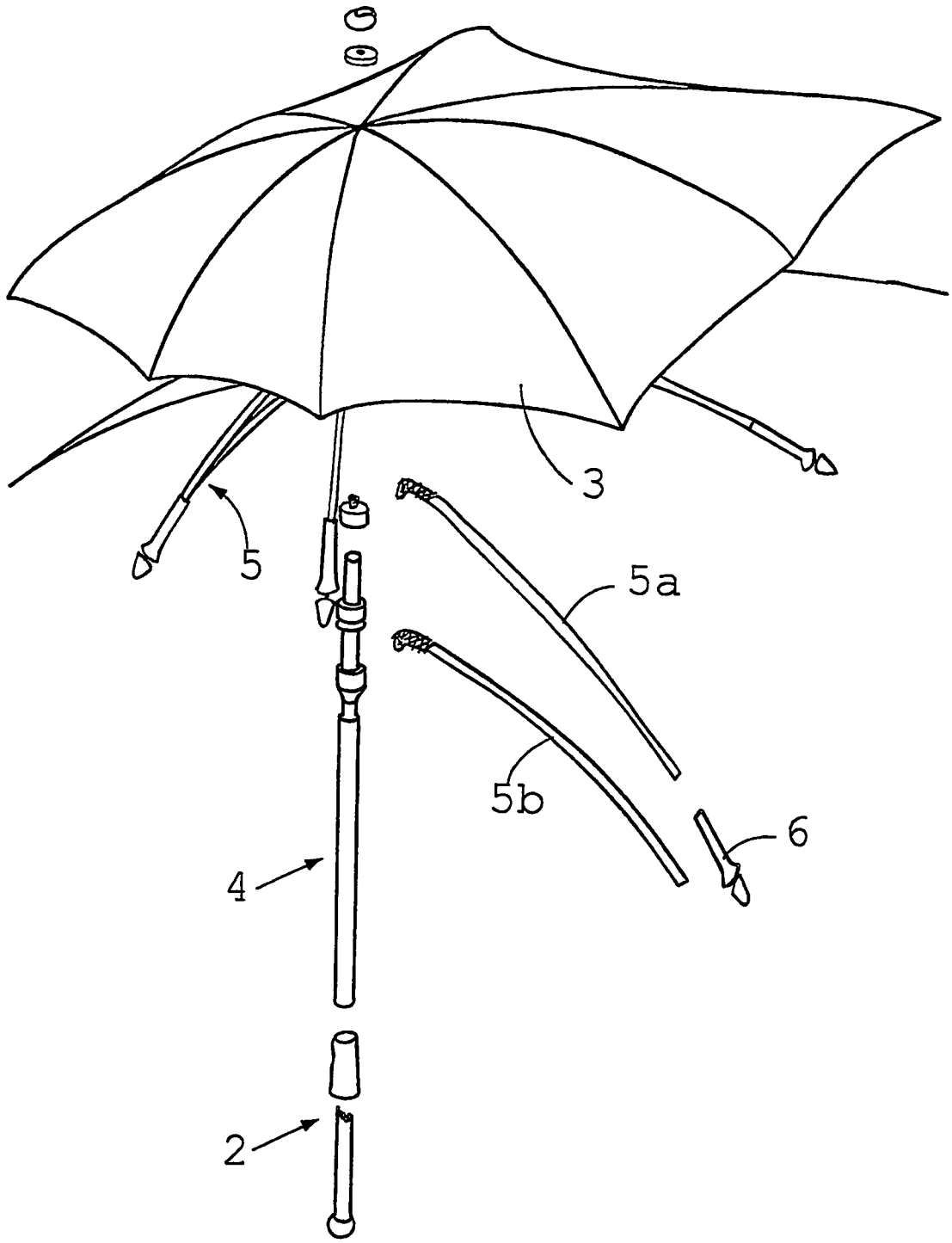
FIG. 1 shows a perspective view of the canopy device according to a preferred embodiment of the present invention.

The preferred embodiments as shown in FIGS. 1 to 16 comprise a canopy device 1 (umbrella or parasol), a rod 2 with operating means 4 for closing or opening canopy 3, wherein the canopy is tensioned in the opened position using canopy tensioning means 5 comprising first tensioning members 5*a* and second tensioning members 5*b*. The canopy 3, which can be used to protect the user from weather influences such as rain or sun, consists of a flexible and preferably durable and water-repellent material, such as for instance polyester fabric.

Figure 12:
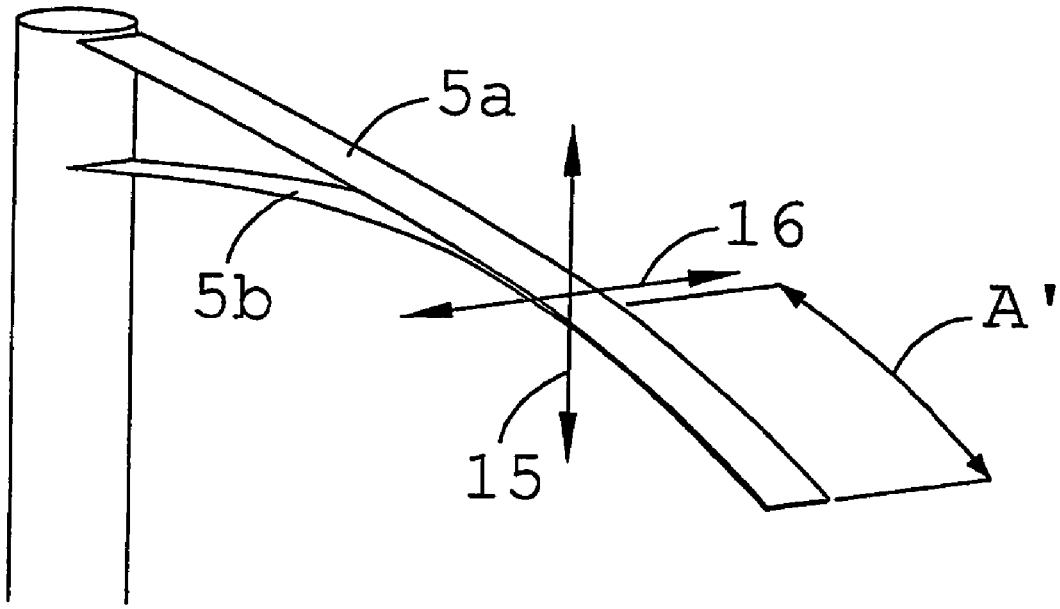
FIG. 12 is a perspective view of a canopy device with first and second tensioning members comprising a contact surface in a loaded position.
Figure 13:
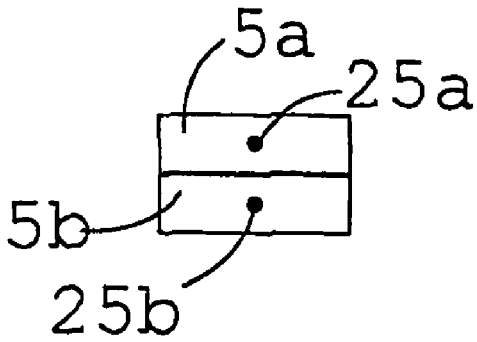
FIG. 13 shows a cross-sectional view of first and second tensioning members which have a lower bending stiffness in a first direction than in a second direction.
Figure 14:
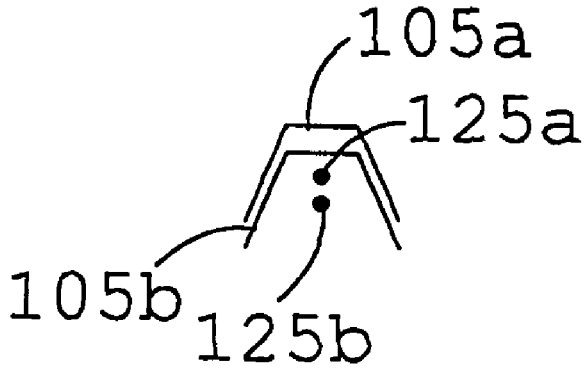
FIG. 14 shows a cross-sectional view of a preferred embodiment in which the profiles of the tensioning members have co-acting forms.

The first 5*a* and second tensioning members 5*b* or ribs are mutually connected in the vicinity of, or even at the position of, the peripheral edge of canopy 3. This prevents the outer part of canopy 3 being folded back when the wind catches the underside thereof, as is often the case with conventional canopy devices. Tensioning members 5*a* and 5*b* extend substantially parallel over some distance from their mutual connection, for instance a glue connection, wherein they have a contact surface which can absorb forces which occur the instance when the umbrella is exposed to gusts of wind. Canopy device 1 according to the present invention provides a robust umbrella in that an alternative is applied, based on contact surfaces, to the vulnerable pivot points which in present umbrellas are often mounted on the ribs. When the umbrella is loaded as a result of the wind strength, the ribs (the first 5*a* and second tensioning members 5*b*) will generate, where generate is used in the meaning of transferring a curved surface to a substantially flat surface like the uncoiling of a foot when walking, over this contact surface and so absorb and distribute the force over this contact surface. FIG. 12 shows a canopy device with first 5*a* and second tensioning members 5*b* with a contact surface A. As a result of a load the contact surface A' will increase due to the generation, as shown in FIG. 13. Peak loads such as occur in conventional rib constructions with hinges are prevented by this generation.

The first and second tensioning members 5*a*, 5*b* take a form such that a generation is guaranteed wherein the contact surface is maintained. When loaded, the tensioning members will hereby not shift along each other and load and possibly damage the canopy.

In a preferred embodiment the tensioning members have a substantially lower bending stiffness in a first direction 15 than in a second direction 16. In the embodiment shown in FIGS. 1 and 4 the tensioning members are embodied as flat strips. Such flat strips bend relatively easily in a first direction 15 perpendicularly of the plane of the strip but have relative bending stiffness in the transverse direction 16, i.e. in the plane of the strip. When loaded, the tensioning members will bend in the first direction 15 and here define a contact surface A which becomes increasingly larger and which absorbs the load. Because the bending stiffness in transverse direction 16 is greater than the bending stiffness in the first direction 15 perpendicularly of the plane of the strip forming the tensioning member, this direction corresponding to the direction of load, the tensioning members will only bend very little in lateral direction. The central axes 25*a*, 25*b* of the first and second tensioning members will hereby undergo only a very small relative displacement in transverse direction 16. The contact surface is therefore maintained and the possibility of the tensioning members shifting along each other is in this way prevented.

Figure 15:
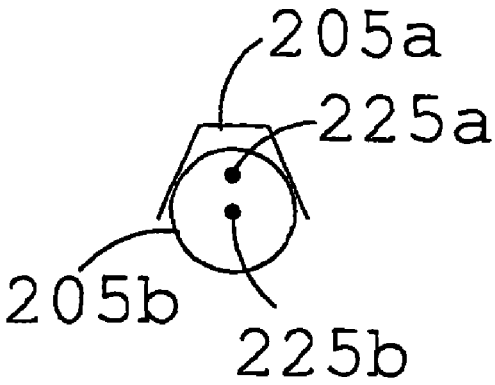
FIG. 15 shows a cross-sectional view of a further preferred embodiment in which the profiles of the tensioning members have co-acting forms.
Figure 16:
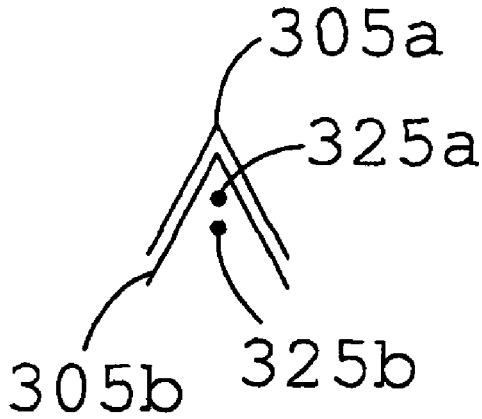
FIG. 16 shows a cross-sectional view of yet another preferred embodiment in which the profiles of the tensioning members have co-acting forms.

In a further preferred embodiment the first and second tensioning members comprise co-acting forms which ensure that the first and second tensioning members are guided in each other. This ensures that a contact surface is maintained between the tensioning members and the tensioning members are prevented from shifting along each other. Specifically the second tensioning members 105*b*, 205*b*, 305*b* are, due to their form, guided or nested in the first tensioning members 105*a*, 205*a*, 305*a*. As the load increases the first and second tensioning members will obtain an increasingly larger contact surface and the co-acting forms of the first and second tensioning members will ensure that a relative movement in transverse direction between the two tensioning members is prevented. A non-exhaustive number of examples of profiles guaranteeing such a form-fitting are shown in FIGS. 13, 14, 15 and 16. As shown in FIG. 15, it is not essential that both tensioning members have the same profile shape.

The operating means 4 (FIG. 5) are displaceable and preferably take the form of a hollow tube which encloses rod 2 for a significant part of its length and is slidable therealong. When canopy 3 is closed, this hollow tube occupies an uppermost position close to the connection of canopy 3 to rod 2, and is movable downward therefrom along rod 2 in order to open canopy 3. Operating means 4 are preferably manufactured from a UV-resistant, stiff material which can be injection moulded and glued, such as for instance POM. On the side where tensioning members 5*b* are mounted the operating means 4 comprise a so-called runner 10, which is shown in detail in FIG. 8.

Figure 8:
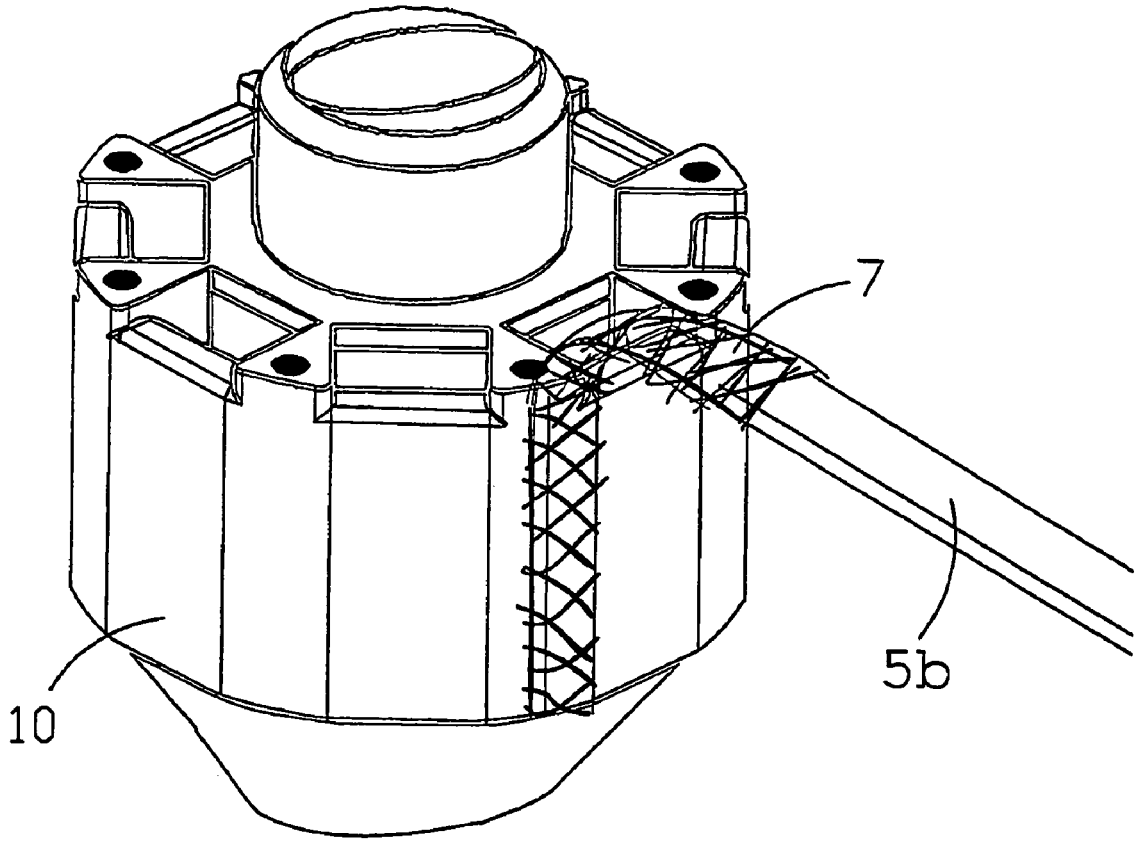
FIG. 8 shows a perspective view of the operating means, wherein one second tensioning member is arranged.

The pivotable connection between operating means 4 and each of the second tensioning members 5*b* comprises a substantially flexible pivot element 7 which is connected on one side to the first outer end of the second tensioning member 5*b* and on the other side to the displaceable operating means 4 (FIG. 8). Pivot element 7 is preferably embodied in fibres of a flexible and durable material, such as for instance aramid or Dyneema®. Pivot element 7 is more preferably manufactured from fibres or fibre ribbons woven in the form of a sleeve, wherein one end of this sleeve is arranged round the first outer end of the second tensioning member 5*b* and fixed thereto by glueing or crimping (FIG. 8). The other outer end of the sleeve-like pivot element is fixed by clamping to the displaceable operating means 4.

Figure 7:
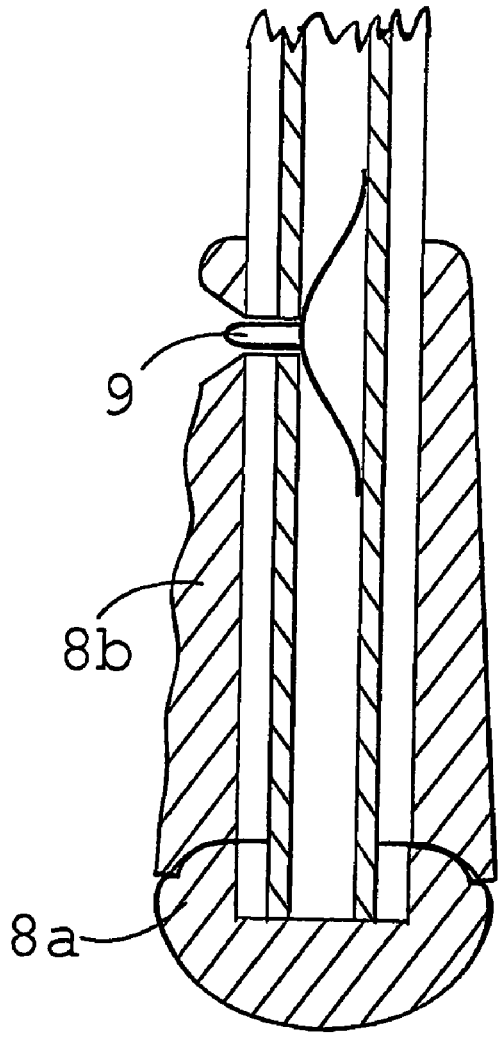
FIG. 7 is a cross-sectional view of the handle in a second opened position of the canopy device shown in FIG. 1.

The handle comprises two parts, of which the first part 8*a* is arranged on rod 2 and the second part 8*b* on operating means 4. In the closed position of canopy 3 these two individual parts of handle 8 are remote from each other (FIG. 6), and the umbrella can be carried with the preferably knob-like part arranged on rod 2. When the two separate parts of the handle are displaced toward each other so that they form substantially one whole (FIG. 7), the umbrella will be opened, i.e. canopy 3 will be moved to an outspread position. When the umbrella is in this extreme position, a locking member 9 in the form of a button biased by means of a curved metal strip provides a locking which ensures that the umbrella remains locked in this opened position (FIG. 7). The locking can be released by pressing in this locking member 9, and the umbrella can be closed again by moving apart the two handle parts 8*a* and 8*b*.

Figure 9:
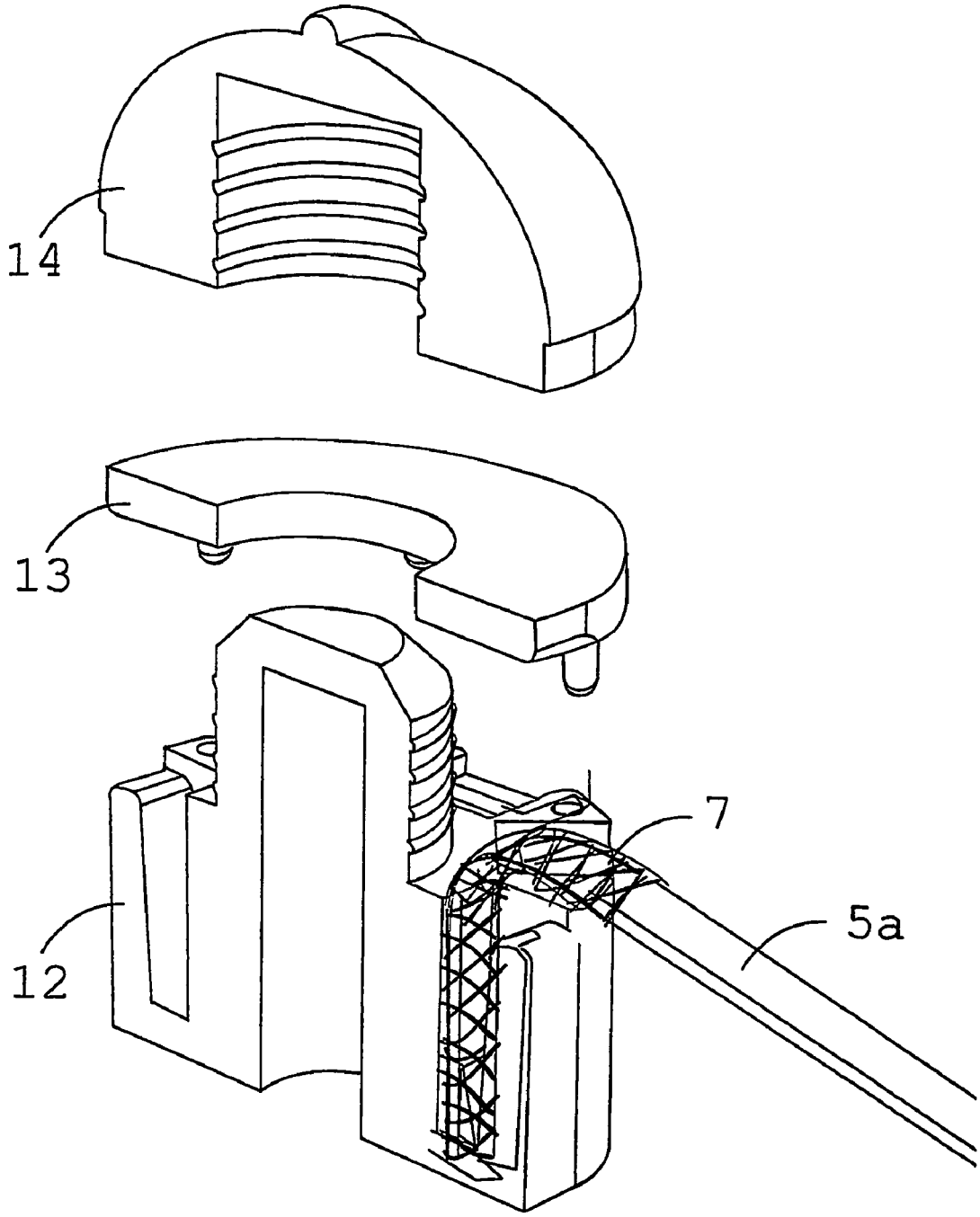
FIG. 9 shows a perspective view of the mounting means on the end of the rod opposite the handle.

Arranged on the outer end of rod 2 opposite the handle are mounting means 11 comprising a cap 12, a positioning ring 13 and a cover 14 (FIG. 9).

Figure 4:
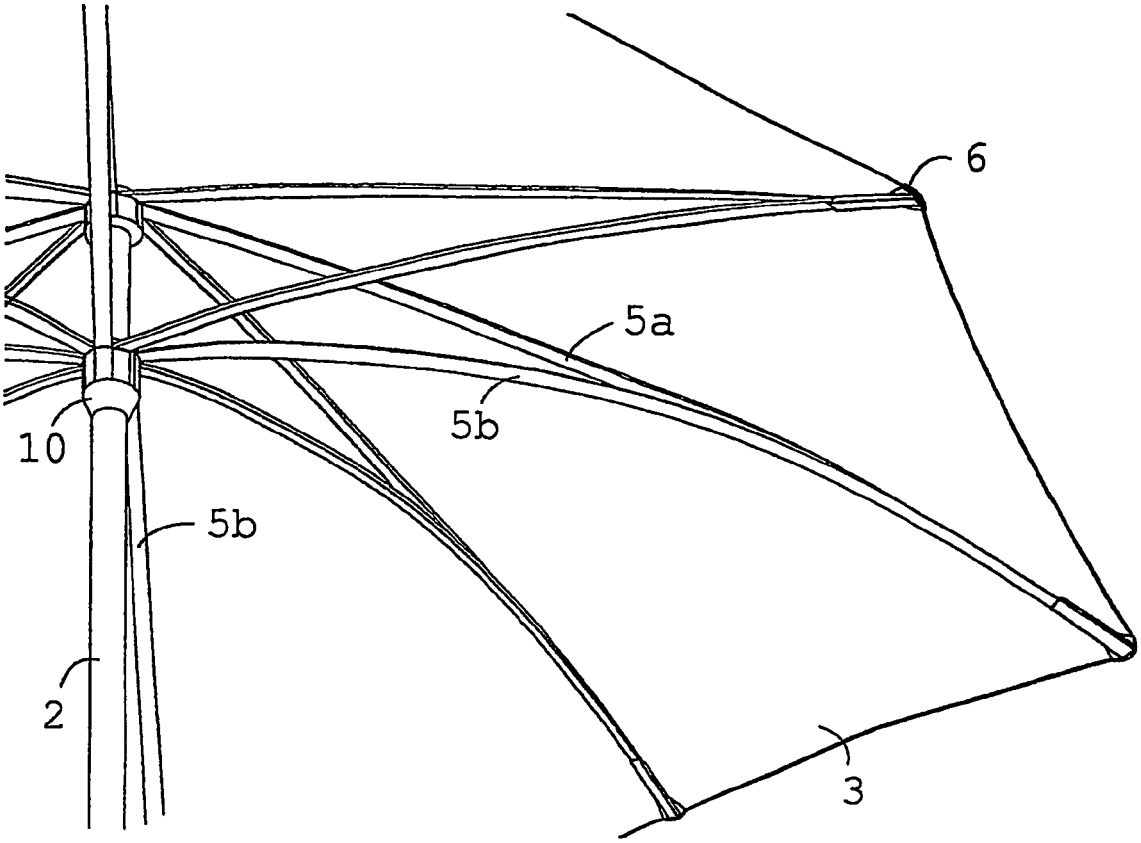
FIG. 4 is a perspective bottom view of the tensioning means of the canopy device shown in FIG. 1 in opened position.
Figure 5:
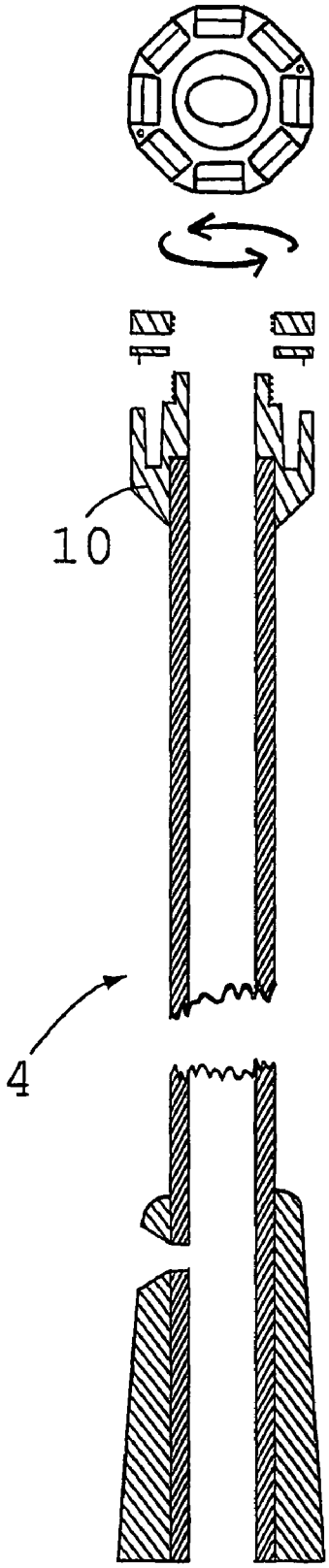
FIG. 5 is a cross-sectional view of the operating means of the canopy device shown in FIG. 1.
Figure 6:
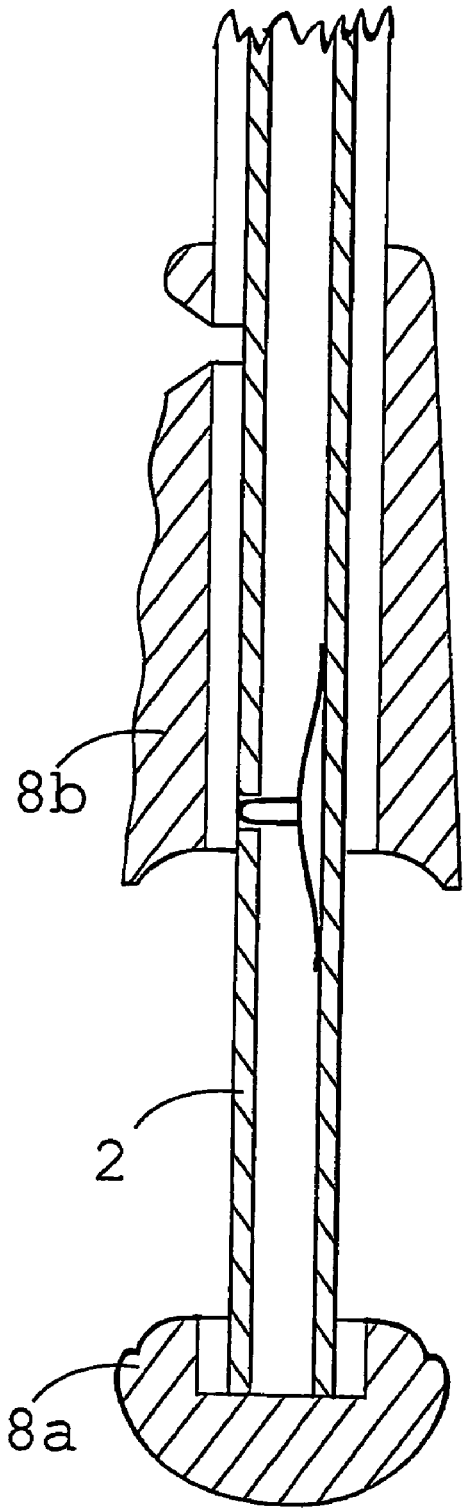
FIG. 6 is a cross-sectional view of the handle in a first closed position of the canopy device shown in FIG. 1.

When canopy 3 is situated in opened position, the tensioning means 5 consisting of first 5*a* and second tensioning members 5*b* extend substantially radially from rod 2. In this opened position at least the second tensioning members 5*b* are under bias (FIG. 4). At least the second tensioning members 5*b* are preferably manufactured from a fibre-reinforced plastic, and ideally all tensioning members are manufactured from a fibre-reinforced plastic.

Figure 2:
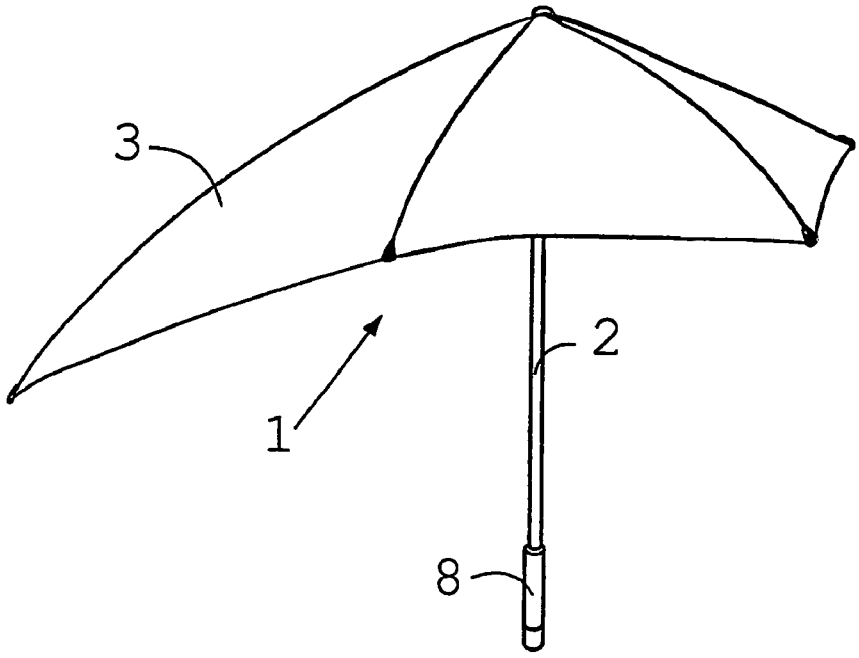
FIG. 2 is a side view of the canopy device shown in FIG. 1.
Figure 3:
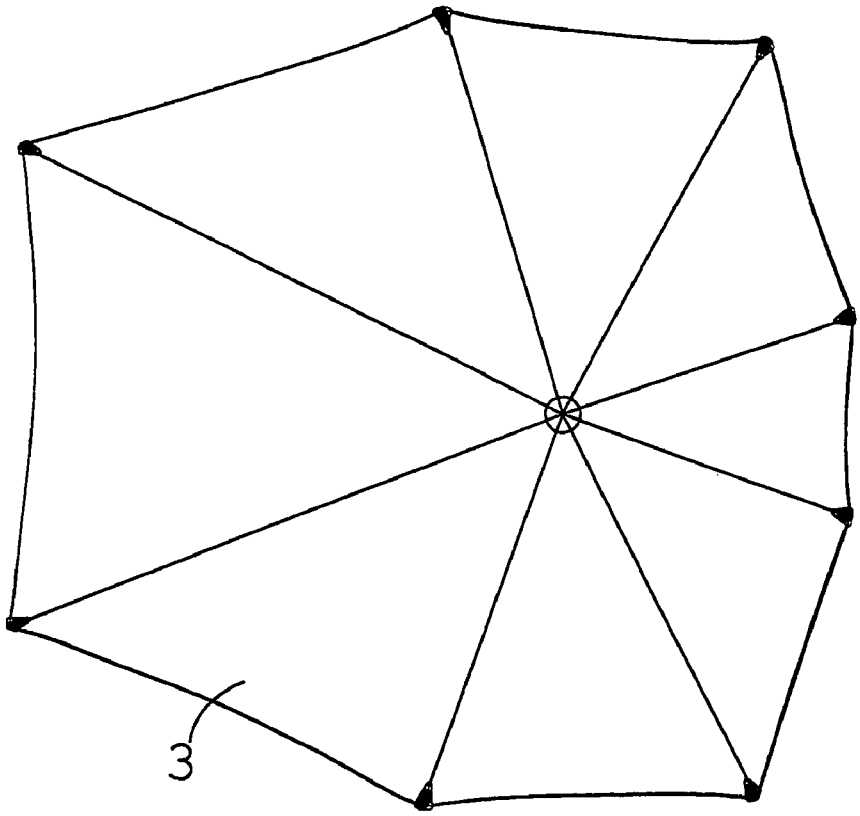
FIG. 3 is a top view of the canopy device shown in FIG. 1.

In the shown preferred embodiment canopy 3 has an asymmetrical form and rod 2 is connected eccentrically to canopy 3 (FIG. 1-3). Tensioning members 5*a* and 5*b* will have different lengths in accordance with the asymmetrical form (FIG. 3), which substantially corresponds in a side view with a wing profile (FIG. 2) and in a top view is substantially egg-shaped (FIG. 3). Because canopy 3 has an asymmetrical form, canopy device 1 has improved aerodynamics which ensure that it assumes a stable position when it is exposed to gusts of wind. As a result the resistance will decrease discernibly and the umbrella according to the present invention will be more comfortable to handle in windy weather conditions. Furthermore, owing to this self-adjusting equilibrium the canopy device is less likely to be overloaded, which will enhance durability.

The asymmetrical form of canopy 3 also provides the user with the option of carrying the rod 2 of the umbrella next to him/her when there is little wind and still holding canopy 3 above the body.

Figure 10:
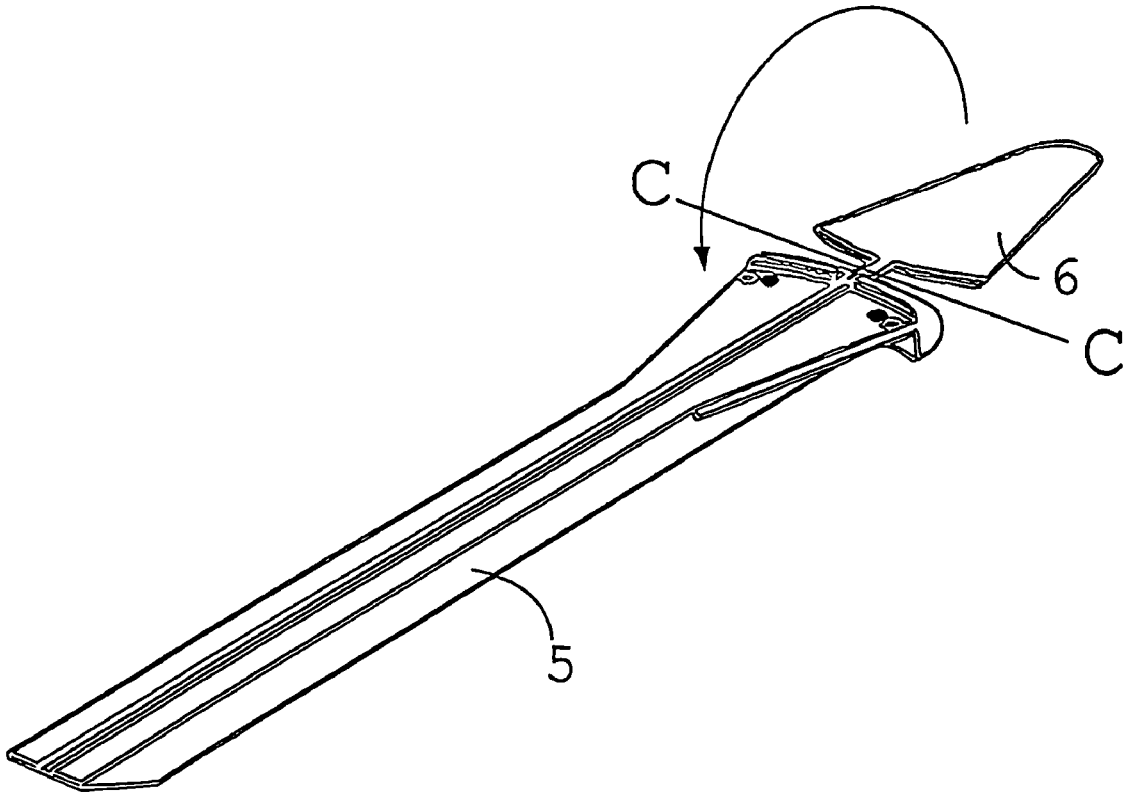
FIG. 10 shows a perspective view of a tensioning member.
Figure 11:
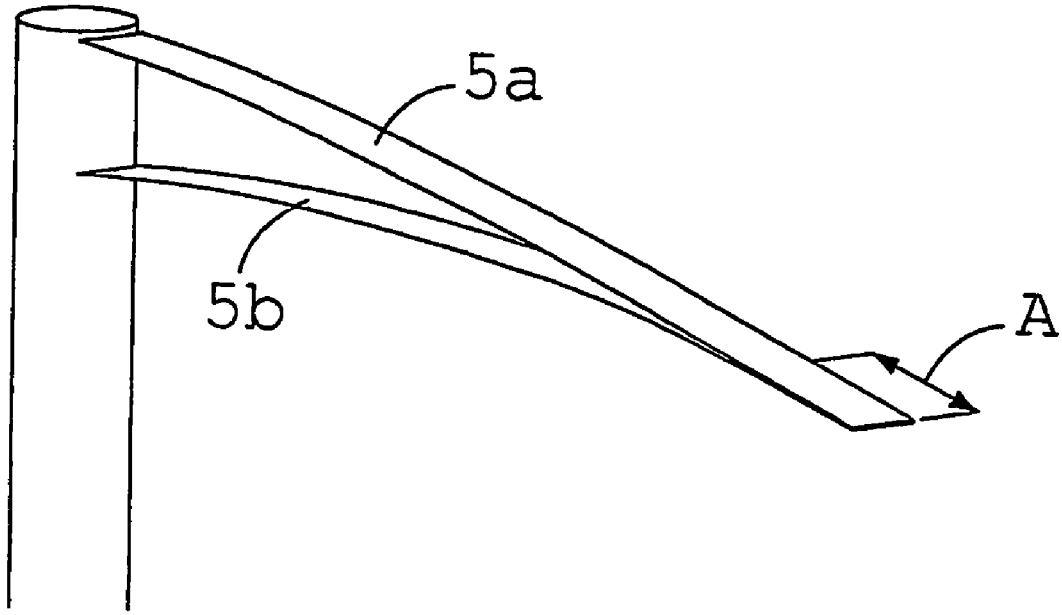
FIG. 11 is a perspective view of a canopy device with first and second tensioning members comprising a contact surface in a substantially non-loaded position.

The canopy device is preferably embodied with protective means 6 for protecting the outer ends of tensioning members 5*a* and 5*b* lying close to the periphery of canopy 3, these protective means 6 comprising for instance a guard for each outer end. In a preferred embodiment this guard is pivotable around an axis C-C, as shown in FIG. 10, arranged on the outer end of one of the tensioning members 5*a* or 5*b* opposite rod 2, whereby this guard can also be pivoted to a folded-in position (FIG. 10). Canopy 3 can also be clamped in the folded-in position of protective means 6. In the folded-in position thereof the guard provides a rounded surface on the canopy periphery which comprises substantially no protruding parts and therefore has a reduced risk of injuring passers-by when canopy 3 is in the opened position.

In a further preferred embodiment (not shown here) rod 2 and tensioning members 5*a* and 5*b* can take a divided form, wherein the dimensions of the parts of rod 2 and tensioning members 5*a* and 5*b* substantially correspond, and rod 2 is movable between a ready-to-use position and a storing position in which the dimensions of canopy device 1 are considerably smaller than in the ready-to-use position. The canopy device according to the invention can thus be stored very compactly, whereby it can be put away in a bag or coat pocket.

The above described embodiments, although they show preferred embodiments of the invention, are intended solely by way of illustration of the present invention and not to limit in any way the specification of the device. The different new aspects of the canopy device according to the invention can, while retaining the associated advantages, also be applied in other combinations and optionally even in otherwise conventional canopy devices. The described and shown pivot connection for instance could thus also be used for applications other than parasols or umbrellas, for instance as connection between the boom and the mast of a sailing boat or sailboard. The scope of the invention is therefore defined solely by the following claims.

The invention claimed is:

1. A canopy system, comprising:

a rod;

a canopy of flexible material connected to the rod close to an end of the rod;

an operating device displaceable along the rod for closing or opening the canopy; and a tensioning device for tensioning the canopy, the tensioning device comprising a set of first tensioning members and a set of second tensioning members, wherein the first tensioning members are each pivotally connected at a first outer end to the rod and extend therefrom along the canopy to a second outer end close to the periphery of the canopy, wherein the second tensioning members are each pivotally connected at a first outer end to the operating device and extend therefrom to a second outer end close to the periphery of the canopy, the first outer ends of the corresponding first and second tensioning members being spaced apart from each other along the rod when the canopy is in an open position, the second outer ends of the corresponding first and second tensioning members being connected to each other substantially close to the periphery of the canopy;

wherein the first and second tensioning members extend substantially parallel in contact with each other over a distance from their mutual connection toward the rod to define a mutual contact surface area;

wherein when wind applies a load to the canopy, the mutual contact surface area between the first and second tensioning members increases to an increased mutual contact surface area and the central axes of the tensioning members are not substantially transversely displaced, thereby absorbing the load while preventing the first and second tensioning members from shifting past each other; and wherein the canopy a has an as asymmetrical form the rod is connected eccentricall to the canopy, and the tensioning members have differing lengths.

2. The canopy system of claim 1, wherein the first and second tensioning members have co-acting forms which ensure that the first and second tensioning members are guided along each other.

3. The canopy system of claim 1, wherein the displaceable operating device comprises a hollow tube which encloses a significant part of the length of the rod and is slidable thereallong.

4. The canopy system of claim 3, wherein when the canopy is closed the hollow tube occupies an uppermost position close to the connection of the canopy to the rod, and is movable downward therefrom along the rod in order to open the canopy.

5. The canopy system of claim 1, wherein the tensioning members extend substantially radially from the rod and at least the second tensioning members are under bias when the canopy system is in an opened position.

6. The canopy system of claim 1, wherein a side view of the asymmetrical form of canopy substantially corresponds to a wing profile.

7. The canopy system of claim 1, wherein a top view of the canopy is substantially egg-shaped.

8. The canopy system of claim 1, further comprising devices for protecting the outer ends of the tensioning members located close to a periphery of the canopy.

9. The canopy system of claim 8, wherein the devices for protecting the outer ends of the tensioning members comprise a guard for each outer end.

10. The canopy system of claim 1, wherein the pivotable connection between the operating device and each of the second tensioning members comprises a substantially flexible pivoting element which is connected on one side to the first outer end of the second tensioning member and on the other side to the displaceable operating device.

11. The canopy system of claim 10, wherein the pivot element comprises fibres of a flexible and durable material.

12. The canopy system of claim 10, wherein the pivot element is woven from fibres or fibre ribbons.

13. The canopy system of claim 10, wherein the pivot element takes the form of a sleeve, one end of which is arranged round the first outer end of the second tensioning member and is fixed thereto by glueing or crimping.

14. The canopy system of claim 13, wherein the other end of the sleeve-like pivot element is fixed by clamping to the displaceable operating means.

15. The canopy system of claim 1, wherein the second tensioning members are manufactured from a fibre-reinforced plastic.

16. The canopy system as claimed in claim 15, wherein the first and second tensioning members are manufactured from a fibre-reinforced plastic.

17. The canopy system of claim 15, wherein the first and second tensioning members are connected by glue.

18. A canopy system, comprising:

a rod;

a canopy of flexible material connected to the rod close to an end of the rod;

an operating device displaceable along the rod for closing or opening the canopy; and a tensioning device for tensioning the canopy, the tensioning device comprising a set of first tensioning members and a set of second tensioning members, wherein the first tensioning members are each pivotally connected at a first outer end to the rod and extend therefrom along the canopy to a second outer end close to the periphery of the canopy, wherein the second tensioning members are each pivotally connected at a first outer end to the operating device and extend therefrom to a second outer end close to the periphery of the canopy, the first outer ends of the corresponding first and second tensioning members being spaced apart from each other along the rod when the canopy is in an open position, the second outer ends of the corresponding first and second tensioning members being connected to each other substantially close to the periphery of the canopy;

wherein the first and second tensioning members extend substantially parallel in contact with each other over a distance from their mutual connection toward the rod to define a mutual contact surface area;

wherein at least one of the first or second tensioning members has a substantially lower bending stiffness in a first direction than in a second direction, the first direction being substantially parallel to the rod when the canopy is in an open position, the second direction being transverse to the first direction;

wherein when wind applies a load to the canopy, the mutual contact surface area between the first and second tensioning members increases to an increased mutual contact surface area and the central axes of the tensioning members are not substantially relatively displaced in the second direction, thereby absorbing the load while preventing the first and second tensioning members from shifting past each other; and wherein the canopy has an asymmetrical form, the side view of the canopy substantially corresponding to a wing profile and the top view of the canopy being substantially egg-shaped, the rod is connected eccentrically to the canopy, and the tensioning members have differing lengths, such that the canopy device takes up a stable position when exposed to wind, thereby achieving a self-adjusting equilibrium.

19. A canopy system, comprising:

a rod;

a canopy of flexible material connected to the rod close to an end of the rod;

an operating device displaceable along the rod for closing or opening the canopy; and a tensioning device for tensioning the canopy, the tensioning device comprising a set of first tensioning members and a set of second tensioning members, wherein the first tensioning members are each pivotally connected at a first outer end to the rod and extend therefrom along the canopy to a second outer end close to the periphery of the canopy, wherein the second tensioning members are each pivotally connected at a first outer end to the operating device and extend therefrom to a second outer end close to the periphery of the canopy, the first outer ends of the corresponding first and second tensioning members being spaced apart from each other along the rod when the canopy is in an open position, the second outer ends of the corresponding first and second tensioning members being connected to each other substantially close to the periphery of the canopy;

wherein the first and second tensioning members extend substantially parallel in contact with each other over a distance from their mutual connection toward the rod to define a mutual contact surface area;

wherein at least one of the first or second tensioning members has a substantially lower bending stiffness in a first direction than in a second direction, the first direction being substantially parallel to the rod when the canopy is in an open position, the second direction being transverse to the first direction;

wherein when wind applies a load to the canopy, the mutual contact surface area between the first and second tensioning members increases to an increased mutual contact surface area and the central axes of the tensioning members are not substantially relatively displaced in the second direction, thereby absorbing the load while preventing the first and second tensioning members from shifting past each other;

wherein the first and second tensioning members have co-acting forms which ensure that the first and second tensioning members are guided along each other; and wherein the canopy has an asymmetrical form, the rod is connected eccentrically to the canopy, and the tensioning members have differing lengths.

* * * * *

UNITED STATES PATENT AND TRADEMARK OFFICE

CERTIFICATE OF CORRECTION

PATENT NO. : 7,992,581 B2
APPLICATION NO. : 11/921780
DATED : August 9, 2011
INVENTOR(S) : Gerrit Hoogendoorn It is certified that error appears in the above-identified patent and that said Letters Patent is hereby corrected as shown below:

IN THE CLAIMS:

Column 6, Line 9, Claim 1, “a has an as” should read -- has an --

Column 6, Line 9, Claim 1, “form” should read -- form, --

Column 6, Line 10, Claim 1, “eccentricall” should read -- eccentrically --

Signed and Sealed this
Third Day of January, 2012

David J. Kappos

David J. Kappos
*Director of the United States Patent and Trademark Office*